US007517068B2

(12) United States Patent
Jung et al.

(10) Patent No.: US 7,517,068 B2
(45) Date of Patent: Apr. 14, 2009

(54) INK CARTRIDGE

(75) Inventors: Myung-song Jung, Gunpo-si (KR); Young-soo Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 446 days.

(21) Appl. No.: 10/963,536

(22) Filed: Oct. 14, 2004

(65) Prior Publication Data

US 2005/0174401 A1 Aug. 11, 2005

(30) Foreign Application Priority Data

Feb. 6, 2004 (KR) ..... 10-2004-0007970

(51) Int. Cl.
*B41J 2/175* (2006.01)
*B41J 2/05* (2006.01)

(52) U.S. Cl. ..... 347/86; 347/85; 347/66

(58) Field of Classification Search ..... 347/86, 347/85, 84, 66
See application file for complete search history.

(56) References Cited

U.S. PATENT DOCUMENTS

| | | | | |
|---|---|---|---|---|
| 5,619,239 | A | 4/1997 | Kotaki et al. | 347/89 |
| 5,831,653 | A * | 11/1998 | Brandon et al. | 347/87 |
| 6,042,225 | A * | 3/2000 | Altendorf et al. | 347/87 |
| 6,161,920 | A * | 12/2000 | Santhanam et al. | 347/50 |
| 6,293,664 | B1 * | 9/2001 | DeFosse et al. | 347/87 |
| 6,331,054 | B1 * | 12/2001 | Seu et al. | 347/87 |
| 6,474,776 | B1 * | 11/2002 | Murray | 347/40 |
| 6,733,118 | B2 * | 5/2004 | Pingrey et al. | 347/87 |
| 6,746,107 | B2 * | 6/2004 | Giere et al. | 347/65 |
| 6,851,800 | B1 * | 2/2005 | Seu | 347/86 |
| 2004/0201653 | A1 * | 10/2004 | Shyu et al. | 347/86 |
| 2006/0012628 | A1 * | 1/2006 | Anderson et al. | 347/29 |

FOREIGN PATENT DOCUMENTS

| | | |
|---|---|---|
| JP | 11-020195 | 1/1999 |
| JP | 12-141703 | 5/2000 |

OTHER PUBLICATIONS

Korean Office Action dated Sep. 29, 2005.

* cited by examiner

*Primary Examiner*—Stephen D Meier
*Assistant Examiner*—Sarah Al-Hashimi
(74) *Attorney, Agent, or Firm*—Roylance, Abrams, Berdo & Goodman, L.L.P.

(57) ABSTRACT

Disclosed is an ink cartridge for an ink-jet image forming apparatus. The ink cartridge comprises an ink cartridge body having a plurality of ink chambers. The ink chambers are formed by two or more partitioning walls orthogonally intersected with each other within the ink cartridge body. A nose is formed at a position adjacent to the bottom surfaces of the ink chambers. The nose includes openings formed in the opposite sides and a plurality of ink feeding channels forming the central area between the openings and connected to the ink feeding channels, respectively. Sealing members seal each corresponding one of the nose openings.

6 Claims, 6 Drawing Sheets

INK CARTRIDGE

CROSS-REFERENCE TO RELATED APPLICATIONS

This application claims the benefit under 35 U.S.C. §119(a) of Korean Patent Application No. 2004-07970 filed Feb. 6, 2004, in the Korean Intellectual Property Office, the disclosure of which is incorporated herein by reference in its entirety.

BACKGROUND OF THE INVENTION

1. Field of the Invention

The present invention relates to an ink cartridge. In particular, the present invention relates to a color ink cartridge preferably using three colors, such as cyan, magenta and yellow, and having discrete ink feeding passages for the ink of respective colors.

2. Description of the Related Art

In general, an ink-jet printer prints out a desired image by spraying ink onto printing paper. The ink-jet printer is provided with an ink cartridge as a consumable article for storing a predetermined quantity of ink. Representative prior art examples of ink-jet printers have been disclosed in U.S. Pat. Nos. 5,926,195, 6,260,961 and 6,293,664, the entire contents of which are incorporated herein by reference.

FIG. 1 is a perspective view showing a part of a prior art ink cartridge is disclosed in U.S. Pat. No. 6,260,961. As shown, the ink cartridge comprises a body 70 and a plurality of ink compartments 84, 86, 88 defined in the body 70 by a plurality of partitioning walls 80, 82. The ink chambers 84, 86, 88 form individual flow channels via a plug 66 fitted into a slide insert opening 76*a*. A Tape Automated Bonding (TAB) circuit 204 with a plurality of cavities 202 is mounted onto the plug 66. With the ink cartridge constructed as described above, ink feeding channels for feeding ink from the individual ink chambers 84, 86, 88 into the cavities 202 provided in the TAB circuit 204 are integrally formed in the body 70. The ink feeding channels are individually formed in the ink chambers 84, 86, 88, respectively.

However, the ink cartridge as described above has a limited ink feeding capability because it is difficult to form cavities for feeding ink to the TAB circuit 204. The area of the ink feeding ports is reduced when a wall body is formed for attaching a filter (not shown) due to a narrow physical space for such an arrangement. As such, inks cannot be smoothly fed from the individual ink chambers 84, 86, 88 to the cavities 202 at the time of high-speed printing. Consequently, droplets of ink fed to a print head (not shown) via the cavities 202 become irregular, thereby deteriorating the quality of image.

In addition, in order to form the ink feeding channels, it is necessary to seal the opening 76*a* formed in the front face of the ink cartridge via the plug 66, the plug 66 may be installed on the rear surface of the TAB circuit 204. Therefore, upon failing to precisely adjust the height of the plug 66 when attaching the plug 66, the plug 66 protrudes causing interference between the TAB circuit 204 and plug 66. In such a case, the electrical connection to the ink cartridge 50 may be out of order, thereby disturbing the normal printing operation and reducing the reliability of the product.

Furthermore, because the plug 66 is required to seal at least two ink feeding channels, it is necessary to provide partitioning walls to define the individual ink feeding channels on the plug 66. As a result, there is problem in that the shape of the plug 66 becomes complicated, whereby manufacturing costs can be increased and leakage of inks and mixture of colors can be produced in the sealed portion.

If the ink feeding channels are formed on the lateral opposite sides of the print head as described above, the ink feeding channels are completed by the plug 66 being attached to the front face of the ink cartridge. The ink feeding channels completed in this manner have a large volume as compared to ink cartridges of other types. Such a large volume may counterbalance negative pressure caused by capillary attraction produced by a foam member for containing ink, thereby deteriorating the characteristic of negative pressure. In order to overcome this problem, it may be possible to add a certain shape to the plug 66 so as to reduce the volume of the ink feeding chamber. However, this may result in additional processes when fabricating a mold and increase the material costs.

SUMMARY OF THE INVENTION

The present invention has been developed in order to solve the above drawbacks and other problems associated with the conventional arrangement. An aspect of the present invention is to provide an ink cartridge with an improved configuration that improves the injection-moldability of the ink cartridge, thereby lowering the manufacturing costs and preventing leakage of ink and mixture of colors.

In order to achieve the above object, there is provided an ink cartridge according to embodiments of the present invention, wherein a plurality of ink chambers containing inks of different colors with ink feeding channels are integrally formed in the ink cartridge body. The ink feeding channels are sealed by individual sealing members. Injection-molding is typically performed to fabricate an ink cartridge with a body integrally formed with ink feeding channels. At this time, the ink feeding channels are formed by inserting slide cores into lateral sides of the ink cartridge bodyleaving openings at the positions where the slide cores were inserted. Therefore, individual sealing members are fitted into the openings, so that the ink feeding channels are sealed from the outside.

According to an exemplary embodiment of the present invention, the plurality of ink chambers are preferably formed by two or more orthogonally intersected partitioning walls within the ink cartridge body. For example, a total of three ink chambers are formed by first and second partitioning walls that are orthogonally intersected with one another, in which a front ink chamber and a rear ink chamber are separated from one another by the first partitioning wall and the rear ink chamber is divided into a left ink chamber and a right ink chamber by the second partitioning wall. It is preferable that the left and right chambers are symmetrically formed with reference to the second partitioning wall.

It is also preferable that the front ink chamber and rear ink chamber are formed to have lengths in the ratio of 1:2.

In addition, the ink cartridge body preferably includes a nose formed at a position adjacent to each bottom surface of the plurality of ink chambers. The nose is formed with the ink feeding channels in the interior of the ink chambers. It is preferable that a print head is fitted onto the exterior of the nose and the ink feeding channels are formed in the interior of the nose.

Furthermore, it is preferable that the plurality of ink feeding channels comprise: a front ink feeding channel formed in an extended part of the bottom of the front ink chamber in such a way that one end of the front ink feeding channel intersects with the front ink chamber. Left and right ink feeding channels connected to the left and right ink chambers at predetermined parts in the bottoms to intersect with the left and right ink chambers, respectively, wherein the left and right ink feeding channels are separated from one another within the nose by the front channel by sealing the openings formed on the opposite lateral sides of the nose with the sealing members.

It is preferable that the nose has a length longer than the length of the front ink chamber so that the nose is adjacent to the entire area of the bottom of the front ink chamber and a part of the bottom of the rear ink chamber and that the nose comprises a part for mounting a print head, one or more ink passages communicated with the print head, and a carriage mounting datum. Meanwhile, the ink passages may be arranged in a line or in a staggered pattern.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Figure 1:
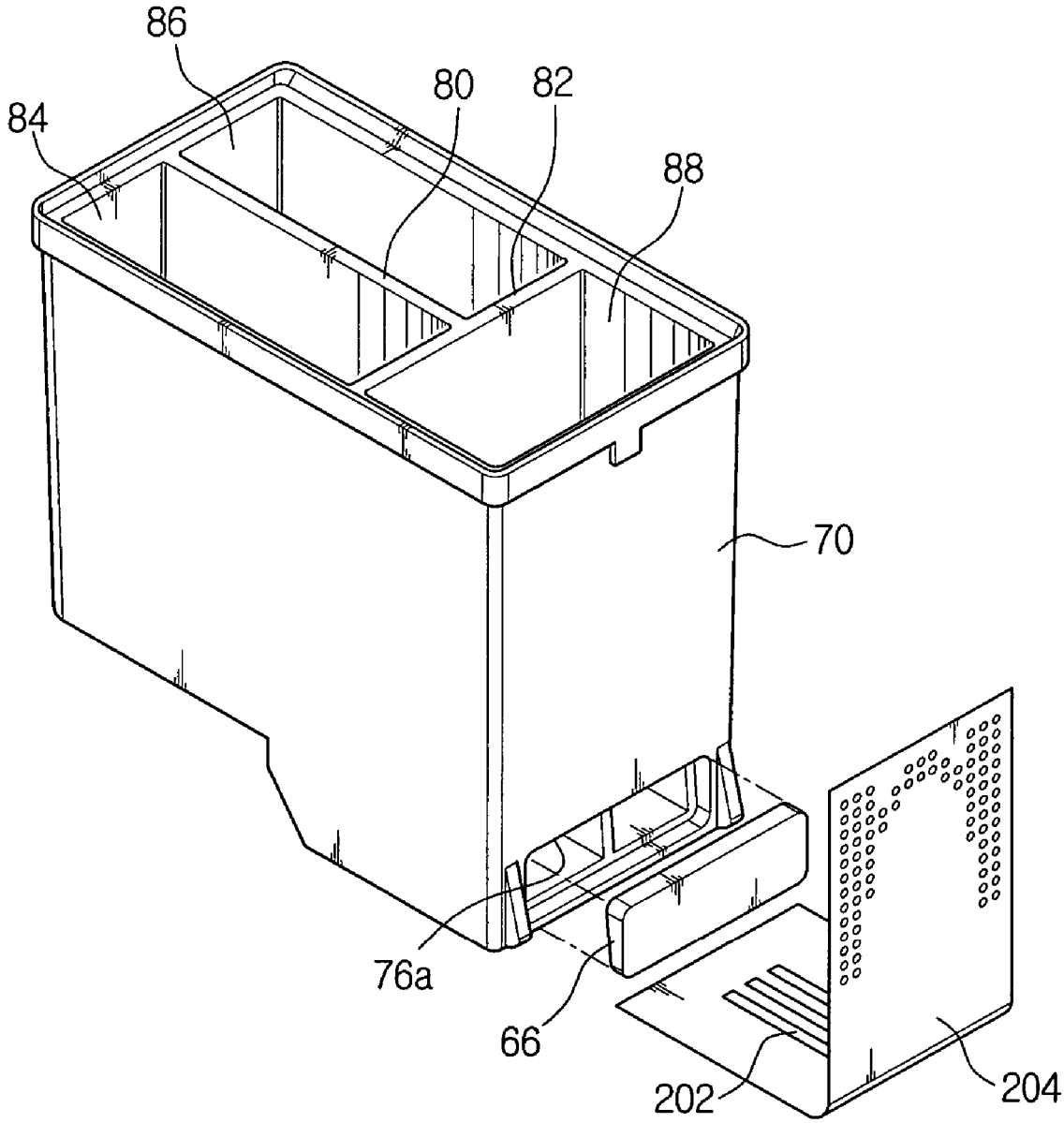
FIG. 1 (PRIOR ART)
FIG. 1 is a perspective view showing a part of a conventional ink cartridge.

Certain embodiments of the present invention will now be described in greater detail with reference to the accompanying drawings.

In the following description, the same drawing reference numerals are used for the same features and structures throughout the drawings. The matters defined in the description such as a detailed construction and elements are provided to assist in a comprehensive understanding of the invention. Thus, it is apparent that the present invention can be carried out with variations in the described embodiments. Also, well-known functions or constructions are omitted for conciseness.

Figure 2:
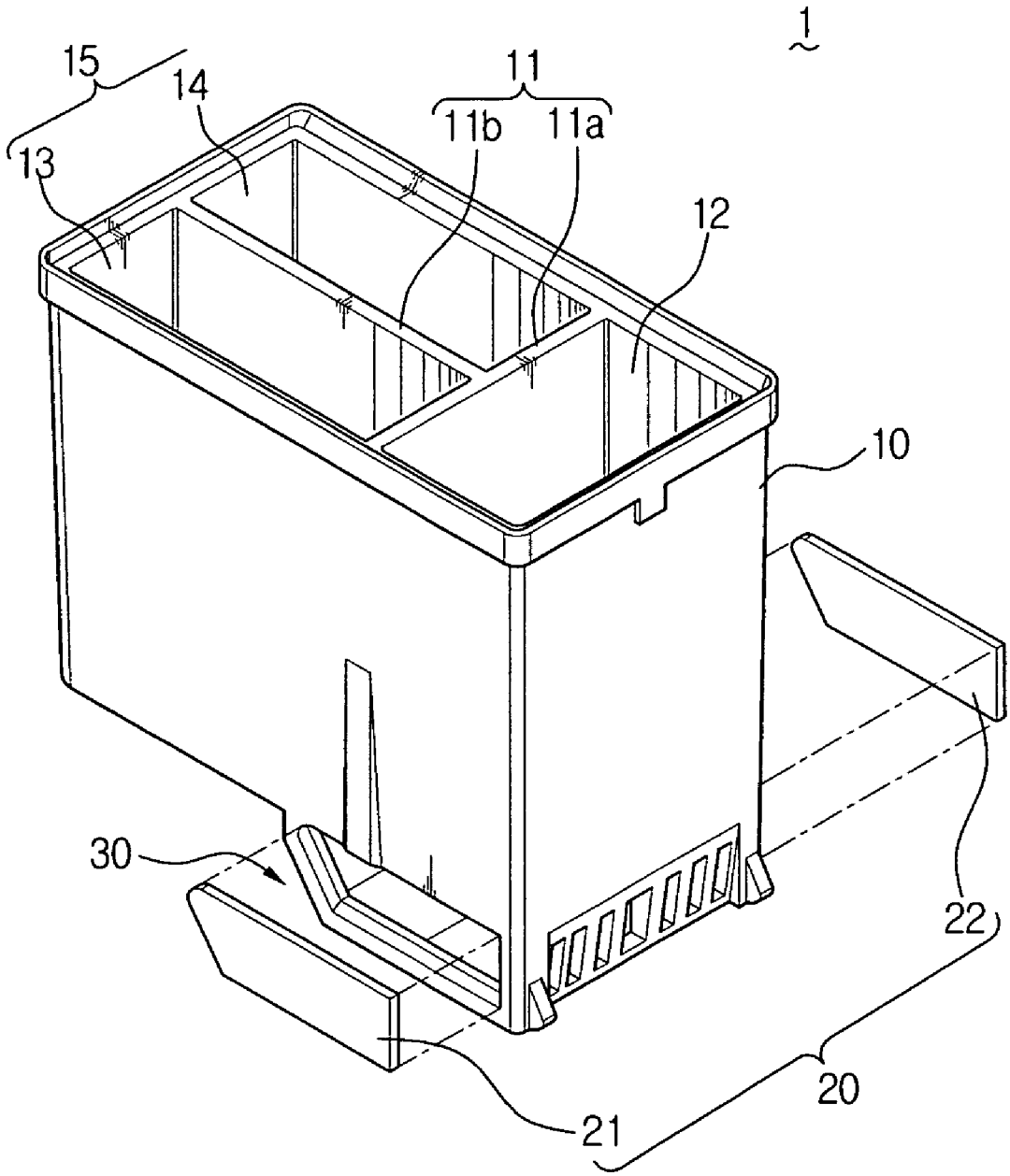
FIG. 2 is a perspective view showing a part of an ink cartridge according to an embodiment of the present invention.

As shown in FIG. 2, the ink cartridge 1 comprises an ink cartridge body 10 with front and rear ink chambers 12, 15 formed in the interior of the ink cartridge body 10. the front and rear ink chambers 12 and 15 are defined by partitioning walls 11*a* and 11*b* that orthogonally intersect with one another. Additionally, the rear ink chamber 15 is divided into left and right ink chambers 13, 14. The partitioning walls preferably comprise a first partitioning wall 11*a* for separating the front ink chamber 12 and the rear ink chamber 15, and a second partitioning wall 11*b* for dividing the rear chamber 15 into the left and right ink chambers 13, 14. The front, left and right ink chambers 12, 13, 14 preferably contain inks of different colors, respectively. Preferably, the inks shall be individually transferred without being mixed until they are ejected from a print head (not shown).

The ink cartridge body 10 is provided with a nose 30 that projects downward from the bottom surface of the cartridge body 10. The interior of the nose 30 is provided with ink feeding channels 12*b*, 13*b*, 14*b* (see FIGS. 4 to 6) that feed ink from the front, left and right ink chambers 12, 13, 14, to a print head (not shown) that is fitted onto the exterior of the nose 30. In addition, sealing members 20 are installed on the opposite lateral sides of the nose 30 to seal the ink feeding channels 12*b*, 13*b*, and 14*b*. The sealing members 20 comprise a left sealing member 21 and a right sealing member 22 that are preferably symmetrical.

The sealing members 20 serve to seal openings formed by slide cores (not shown) inserted into the left and right sides so as to integrally form the ink feeding channels 12*b*, 13*b*, 14*b* in the ink cartridge body 10 when the ink cartridge body 10 is injection-molded. The ink feeding channels 12*b*, 13*b*, and 14*b* are formed by sealing the openings with the sealing members 20.

Figure 3:
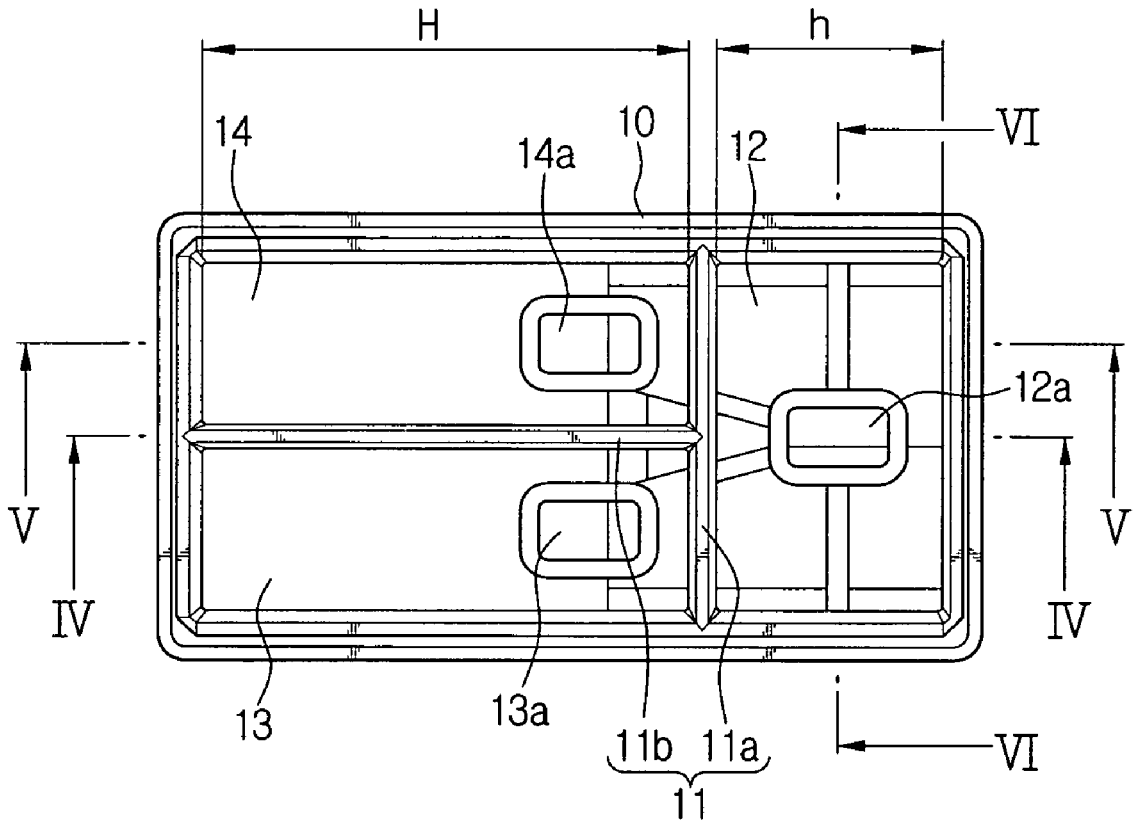
FIG. 3 is a top plan view of FIG. 2 according to an embodiment of the present invention.

FIG. 3 is a plan view of the ink cartridge 10 shown in FIG. 2, in which the front, left and right ink chambers 12, 13, 14 are provided with ink discharge holes 12*a*, 13*a*, 14*a* at the bottoms thereof, respectively, so that the inks contained in the front, left and right ink chambers 12, 13, 14 can be fed to the nose 30 through the discharge holes 12*a*, 13*a*, 14*a*. It is preferable that the length h of the front ink chamber 12 and the length H of the left and right ink chambers 13, 14 are formed with ratio of 1:2.

If the ratio of the length h of the front ink chamber 12 to the length H of the left and right ink chambers 13, 14 is smaller than the above ratio, that is, if the length h of the front ink chamber 12 is longer than that satisfying the above ratio, the length of the ink feeding channels 13*b*, 14*b* (to be described later) from the left and right ink feeding chambers 13, 14 will be increased. As a result, the efficiency of the ink cartridge will deteriorate. Furthermore, insertion of foam members (not shown) into the left and right ink chambers 13, 14 may be difficult, when foam members are required to be incorporated within the left and right ink chambers 13, 14. The external size of a printer will also be increased. Whereas, if the ratio of the length h of the front ink chamber 12 to the length H of the left and right ink chambers 13, 14 is smaller than the above ratio, that is, if the length h of the front ink chamber 12 is shorter than that satisfying the above ratio, the efficiency of the ink cartridge will be enhanced. In such a case, however, there is a problem because the size of a carriage for carrying the ink cartridge will be increased requiring additional space for reciprocating the carriage will be needed, thereby increasing the external size of a printer.

Figure 4:
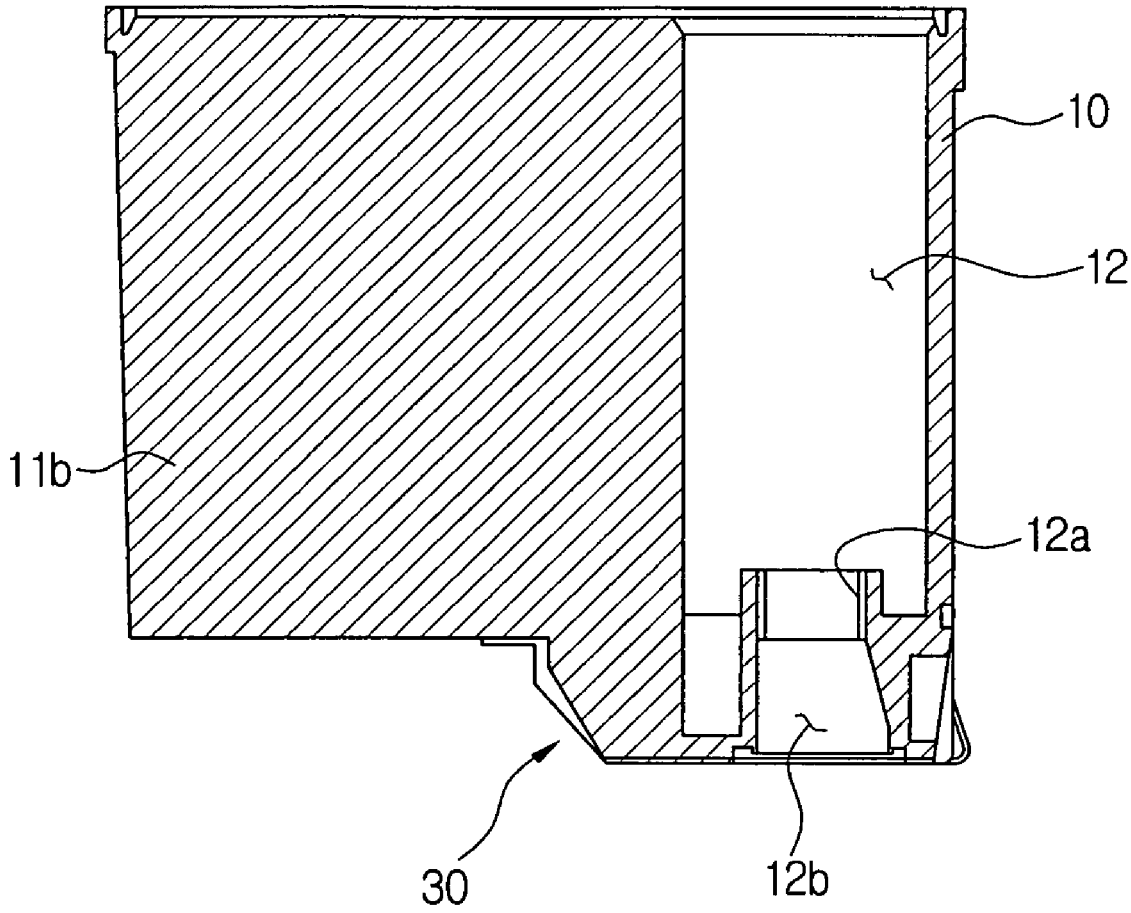
FIG. 4 is a cross-sectional view taken along the line IV-IV of FIG. 3.

As shown in FIG. 4, the front ink chamber 12 includes a front ink discharge hole 12*a* for feeding ink at its bottom, and the front ink discharge hole 12*a* is integrally formed with a front ink feeding channel 12*b*. The front ink feeding channel 12*b* feeds ink to a print head (not shown) through the nose 30.

The front ink discharge hole 12*a* is preferably projected upward to have a predetermined height. This is to make it possible to install a filter for filtering impurities that may be included in the ink contained in the front ink chamber 12.

Figure 5:
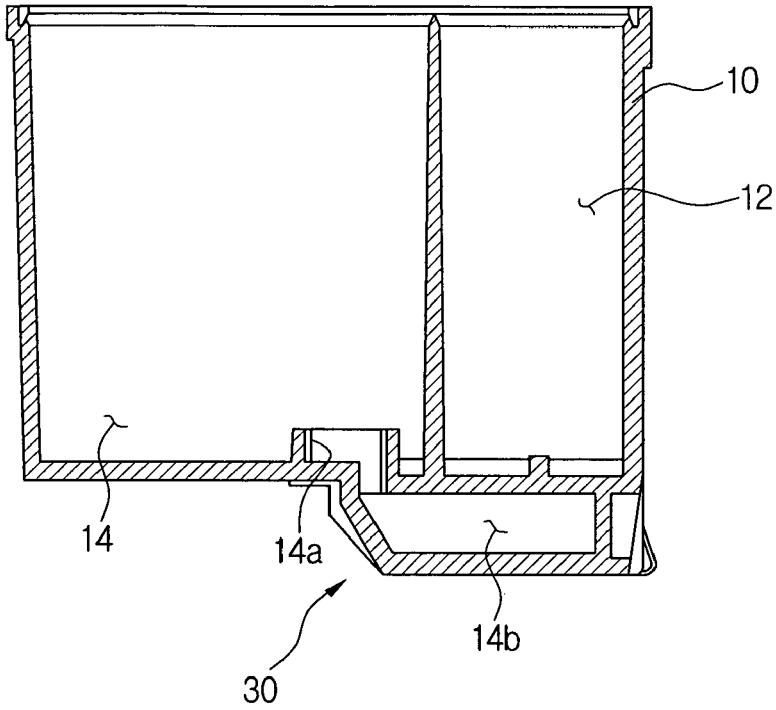
FIG. 5 is a cross-sectional view taken along the line V-V of FIG. 3.

FIG. 5 is a cross-sectional view taken along the line V-V of FIG. 3, which shows the right ink chamber 14 in more detail. Because the left ink chamber 13 and the right ink chamber 14 preferably have the same symmetrical construction, the description of the right chamber 14 can be applied to the left ink chamber 13. Therefore, the description of the left ink chamber 13 is omitted.

As shown in FIG. 5, the interior of the nose 30 is provided with a right ink feeding channel 14*b* connected to a right ink discharge hole 14*a* and integrally formed with the ink cartridge body 10. It is preferable that the right ink discharge hole

14*a* is formed to project upward like the front ink discharge channel 12*a* as described above.

Figure 6:
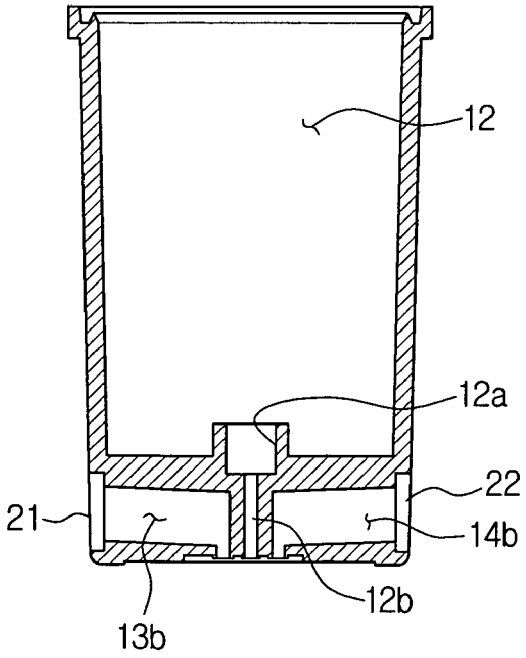
FIG. 6 is a cross-sectional view taken along the line VI-VI of FIG. 3.

FIG. 6 is a cross-sectional view taken along the line VI-VI, in which the ink cartridge 1 is cut away through the front part thereof and viewed in front of the ink cartridge. FIG. 6 also shows the front, left and right ink feeding channels 12*b*, 13*b*, 14*b* each connected to the corresponding one of the ink chambers.

As shown in FIG. 6, the left and right ink feeding channels 13*b*, 14*b* are positioned left and right in reference to the front ink feeding channel 12*b* and sealed by left and right sealing members 21, 22, respectively, thereby forming individual channels.

Since each of the left and right sealing members 21, 22 seals one ink feeding channel, the shape of each sealing member is simplified and therefore manufacturing costs can be reduced. In addition, even if ink leakage occurs from any of the sealing members, inks are still prevented from mixing in the print head.

In addition, the left and right sealing members 21, 22 may be used as a mounting datum in unison when the ink cartridge 1 is mounted on a carriage. Therefore, it is possible to further reduce manufacturing costs since it is not necessary to provide a separate mounting datum on the top surface or a side surface of the ink cartridge 1 as in the prior art.

Meanwhile, if ink feeding channels are formed by left and right sealing members as described above, it is possible to shorten the sliding stroke of the slide cores during injection-molding of an ink cartridge, as compared to the prior art. Therefore, it is possible to prevent an ink cartridge body 10 from being deformed during injection-molding of an ink cartridge 1 according to an embodiment of the present invention. Furthermore, it is possible to enhance freedom of design of cartridge ink feeding slots 31 (see FIG. 7A). This will be described in greater detail with reference to FIGS. 7A to 7C.

Figure 7A:
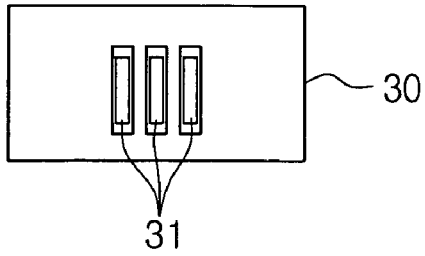
FIG. 7A is a schematic view showing an exemplary state of ink channels of an ink cartridge as being arranged in a line according to an embodiment of the present invention.
Figure 7B:
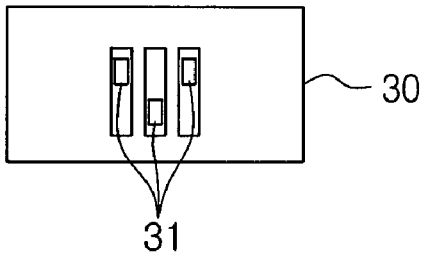
FIGS. 7B and 7C are schematic views showing exemplary states of ink channels of an ink cartridge as being arranged in staggered pattern according to another embodiment of the present invention.
Figure 7C:
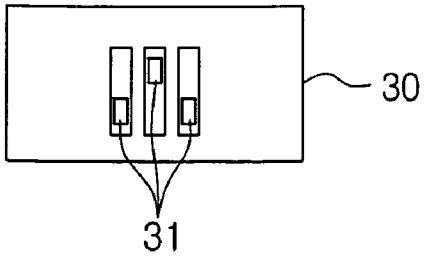

If the cartridge ink feeding slots 31 are arranged in a line as shown in FIG. 7A, it is possible to smoothly feed inks to the print head side because the ink supply may be increased. However, if it is required to miniaturize the ink cartridge body, it is impossible to maintain linear arrangement mainly due to limitations in designing a mold. That is, if the ink cartridge 1 is miniaturized, the cartridge ink feeding slots 31 should be also sized smaller in proportion. However, if the cartridge ink feeding slots 31 are too small, a shape deformation may be produced between two adjacent slots 31 during injection-molding. If the cartridge ink feeding slots 31 are arranged in a staggered pattern as shown in FIGS. 7B and 7C, it is possible to prevent the cartridge ink feeding slots 31 from being deformed due to miniaturization during injection-molding.

As described above in the exemplary embodiments, the installation positions of the sealing members and a print head do not interfere with one another, which enhances design possibilities concerning the arrangement of cartridge feeding slots. In addition, because the length of the slide cores for forming ink feeding channels in the rear ink chambers is shortened, the construction of a mold for forming an ink cartridge body can be simplified making it is possible to manufacture a miniaturized ink cartridge.

Furthermore, the ink feeding channels are individually sealed, so it is possible to prevent ink leakage and mixture of colors, which may be caused when the ink feeding channels are incompletely formed.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An ink cartridge comprising:

an ink cartridge body having a plurality of ink chambers, said ink chambers being formed by two or more partitioning walls intersecting orthogonally with one another within the ink cartridge body;

a nose formed integral with the ink chambers, the nose including a plurality of openings formed in the opposite sides of the nose, respectively, and a plurality of ink feeding channels, wherein each of said plurality of ink feeding channels is individually connected to at least one of said plurality of ink chambers; and sealing members for individually sealing said openings;

wherein the nose comprises:

a part for mounting a print head;

one or more ink passages intersecting with the print head; and a carriage mounting datum;

wherein the carriage mounting datum is formed on the surfaces of the sealing members.

2. The ink cartridge according to claim 1, wherein said plurality of ink chambers comprise:

a front ink chamber; and a rear ink chamber separated from the front ink chamber by a first partitioning wall, the rear ink chamber being divided into a left ink chamber and a right ink chamber, by a second partitioning wall, the left and right ink chambers being symmetrically formed.

3. The ink cartridge according to claim 2, wherein the front ink chamber and rear ink chamber have lengths with a ratio of 1:2.

4. The ink cartridge according to claim 2, wherein said plurality of ink feeding channels comprise:

a front ink feeding channel formed in an extended part of the bottom of said front ink chamber in such a way that the front ink feeding channel intersects with the front ink chamber; and left and right ink feeding channels connected to the left and right ink chambers at predetermined locations in the bottoms thereof to intersect with the left and right ink chambers, respectively, the left and right ink feeding channels being separated from one another in the nose by the front ink feeding channel and formed by sealing the openings with at least one sealing member.

5. The ink cartridge according to claim 2, wherein the nose has a length longer than that of the front ink chamber so that the nose is adjacent to the entire area of the bottom of the front ink chamber and a part of the bottom of the rear ink chamber.

6. An ink cartridge comprising:

an ink cartridge body having a plurality of ink chambers, said ink chambers being formed by two or more partitioning walls intersecting orthogonally with one another within the ink cartridge body;

a nose formed integral with the ink chambers, the nose including a plurality of openings formed in the opposite sides of the nose, respectively, and a plurality of ink feeding channels, wherein each of said plurality of ink feeding channels is individually connected to at least one of said plurality of ink chambers; and sealing members for individually sealing said openings;

wherein the ink passages are arranged in a staggered pattern in the nose.

* * * * *